US007044239B2

(12) United States Patent
Pinckard et al.

(10) Patent No.: US 7,044,239 B2
(45) Date of Patent: May 16, 2006

(54) SYSTEM AND METHOD FOR AUTOMATIC DRILLING TO MAINTAIN EQUIVALENT CIRCULATING DENSITY AT A PREFERRED VALUE

(75) Inventors: Mitchell D. Pinckard, Houston, TX (US); Michael Niedermayr, Sugar Land, TX (US); Charles H. King, Houston, TX (US)

(73) Assignee: Noble Corporation, Sugar Land, TX (US)

( * ) Notice: Subject to any disclaimer, the term of this patent is extended or adjusted under 35 U.S.C. 154(b) by 243 days.

(21) Appl. No.: 10/423,724

(22) Filed: Apr. 25, 2003

(65) Prior Publication Data

US 2004/0211595 A1 Oct. 28, 2004

(51) Int. Cl.
*E21B 19/08* (2006.01)
*E21B 44/06* (2006.01)

(52) U.S. Cl. ..... 175/57; 175/24; 175/27; 175/38; 175/48

(58) Field of Classification Search ..... 175/24, 175/25, 27, 38, 48, 57; 166/250.07
See application file for complete search history.

(56) References Cited

U.S. PATENT DOCUMENTS 4,507,735 A * 3/1985 Moorehead et al. ..... 702/9
4,875,530 A 10/1989 Frink et al. ..... 175/27
5,341,886 A * 8/1994 Patton ..... 175/24
5,474,142 A 12/1995 Bowden ..... 175/27
5,873,420 A * 2/1999 Gearhart ..... 175/25
5,975,219 A * 11/1999 Sprehe ..... 175/48
6,026,912 A 2/2000 King et al. ..... 175/27
6,148,912 A 11/2000 Ward ..... 166/250.07
6,152,246 A 11/2000 King et al. ..... 175/26
6,155,357 A 12/2000 King et al. ..... 175/27
6,189,612 B1 * 2/2001 Ward ..... 166/250.07
6,192,998 B1 2/2001 Pinckard ..... 175/27
6,233,498 B1 5/2001 King et al. ..... 700/174
6,293,356 B1 9/2001 King et al. ..... 175/27
6,357,536 B1 3/2002 Schrader et al. ..... 175/48
6,374,925 B1 4/2002 Elkins et al. ..... 175/25
6,382,331 B1 5/2002 Pinckard ..... 175/27
6,401,838 B1 6/2002 Rezmer-Cooper (Continued)

OTHER PUBLICATIONS

T. Hemphill, et al., "Optimization of Rates of Penetration in Deepwater Drilling: Identifying the Limits", Society of Petroleum Engineers, Inc., 2001, 5 pages.

(Continued)

*Primary Examiner*—David Bagnell
*Assistant Examiner*—Shane Bomar
(74) *Attorney, Agent, or Firm*—Osha Liang LLP

(57) ABSTRACT

A drilling system includes a pressure sensor disposed on a drill string in the wellbore, the sensor responsive to pressure of a drilling fluid disposed in an annular space between a wall of the wellbore and the drill string, and a processor operatively coupled to the pressure sensor. The processor is adapted to operate a drill string release controller to release the drill string into the wellbore so as to maintain an equivalent density of the drilling fluid substantially at a selected value. A method for automatically drilling a wellbore includes measuring pressure of a drilling fluid in an annular space between a wall of the wellbore and a drill string in the wellbore, and automatically controlling a rate of release of the drill string in response to the measured pressure so as to maintain an equivalent density of the drilling fluid substantially at a selected value.

27 Claims, 3 Drawing Sheets

U.S. PATENT DOCUMENTS

| | | | | |
|---|---|---|---|---|
| 6,427,125 | B1 | 7/2002 | Gzara et al. | 702/9 |
| 6,443,228 | B1 * | 9/2002 | Aronstam et al. | 166/250.11 |
| 6,513,606 | B1 * | 2/2003 | Krueger | 175/61 |
| 6,662,884 | B1 * | 12/2003 | Hemphill | 175/48 |
| 2002/0075114 | A1 | 6/2002 | Hall et al. | 336/192 |
| 2002/0108783 | A1 | 8/2002 | Elkins et al. | |
| 2004/0195004 | A1 * | 10/2004 | Power et al. | 175/24 |
| 2004/0238177 | A1 * | 12/2004 | Fossli | 166/364 |
| 2005/0061549 | A1 * | 3/2005 | Evans et al. | 175/62 |

OTHER PUBLICATIONS

Bart E. Vos, et al., "The Benefits of Monitoring Torque & Drag in Real Time", IADC/SPE Asia Pacific Drilling Technology, 2000, 4 pages.

International Search Report dated Aug. 18, 2004, 4 pages.

"Pressure While Drilling Data Improves Reservoir Drilling Performance" Authors: C.D. Ward, Sperry-Sun Drilling Services, and E. Andreassen, Statoil as as published in SPE/IADC 37588, copyright 1997, SPE/IADC Drilling Conference (pp. 159-168).

"Using Downhole Annular Pressure Measurements to Anticipate Drilling Problems" Authors: Mark Hutchinson, Anadrill and Iain Rezmer-Cooper, Schlumberger, SPE members as published in SPE49114, copyright 1998, Society of Petroleum Engineers, Inc. (pp. 535-549).

"Major Advancements in True Real-Time Hydraulics" Authors: M. Zamora, S. Roy, H.Y. Caicedo, T.S. Froitland, and S.-T. Ting, M-I L.L.C. as published in SPE62960, Copyright 2000, Society of Petroleum Engineers, Inc. (12 pages).

"The Use of Resistivity-at-the-Bit Images and Annular Pressure While Drilling In Preventing Drilling Problems" authors: Iain Rezmer-Cooper and Tom Bratton, Schlumberger, Helle Krabbe, Amerada Hess as published in IADC/SPE 59225, copyright 2000, IADC/SPE Drilling Conference (13 pages).

"Using Pressure-While-Drilling Measurements to Solve Extended-Reach Drilling Problems on Alaska's North Slope" authors: C.R. Mallary, ARCO Alaska Inc., Martin Varco, Schlumberger Oilfield Services, D'Arcy Quinn, Schlumberger Oilfield Services as published in SPE 54592, copyright 1999, Society of Petroleum Engineers, Inc. (11 pages).

* cited by examiner

SYSTEM AND METHOD FOR AUTOMATIC DRILLING TO MAINTAIN EQUIVALENT CIRCULATING DENSITY AT A PREFERRED VALUE

BACKGROUND OF INVENTION

1. Field of the Invention

The invention relates generally to drilling boreholes through subsurface formations. More particularly, the invention relates to a method and a system for controlling the rate of release of a drill string to maintain equivalent density at a selected value during drilling.

2. Background Art

Drilling wells in subsurface formations for oil and gas wells is expensive and time consuming. Formations containing oil and gas are typically located thousands of feet below the earth surface. Therefore, thousands of feet of rock and other geological formations must be drilled through in order to establish production. While many operations are required to drill and complete a well, perhaps the most important is the actual drilling of the borehole. The cost associated with drilling a well is primarily time dependent. Accordingly, the faster the desired penetration depth is achieved, the lower the cost for drilling the well. However, cost and time associated with well construction can increase substantially if wellbore instability problems or obstacles are encountered during drilling. Therefore, successful drilling requires achieving a penetration depth as fast as possible but within the safety limits defined for drilling operation.

Achieving a penetration depth as fast as possible during drilling requires drilling at an optimum rate of penetration. The rate of penetration achieved during drilling depends on many factors, however, the primary factor is the axial force (weight) on bit. As disclosed in U.S. Pat. No. 4,535,972 to Millheim, et al., rate of penetration generally increases with increasing weight on bit until a certain weight on bit is reached and then decreases with further weight on bit. Thus, there is generally a particular weight on bit that will achieve a maximum rate of penetration.

However, the rate of penetration of a bit also depends on many factors in addition to the weight on bit. For example, the rate of penetration depends upon characteristics of the formation being drilled, the speed of rotation of the drill bit, and the rate of flow of the drilling fluid. Because of the complex nature of drilling, a weight on bit that is optimum for one set of conditions may not be optimum for another set of conditions.

One conventional method used to determine an optimum rate of penetration for a particular set of drilling conditions is known as a "drill off test," which is disclosed, for example, in U.S. Pat. No. 4,886,129 to Bourdon. During a drill off test, a drill string supported by a drilling rig is lowered into the borehole. When the bit contacts the bottom of the borehole, drill string weight is transferred from the rig to the bit until an amount of weight greater than the expected optimum weight on bit is applied to the bit. Then, while holding the drill string against vertical motion at the surface, the drill bit is rotated at the desired rotation rate with the fluid pumps at the desired pressure. As the bit is rotated, it cuts through the earth formation. Because the drill string is held against vertical motion at the surface, weight is increasingly transferred from the bit to the rig as the bit cuts through the earth formation. As disclosed in U.S. Pat. No. 2,688,871 to Lubinsky, by applying Hooke's law, an instantaneous rate of penetration may be calculated from the instantaneous rate of change of weight on bit. By comparing bit rate of penetration with respect to weight on bit during the drill off test, an optimum weight on bit can be determined. In typical drilling operations, once an optimum weight on bit is determined, a driller (rig operator) attempts to maintain the weight on bit at that optimum value during drilling.

A limitation of using an optimum weight on bit determined from a drill off test is that the weight on bit value thus determined is optimum only for the particular set of conditions experienced during the test, such as drilling fluid ("mud") flow rate, the type of formation being drilled, temperature and pressure conditions, etc. Drilling conditions are dynamic, and during the course of drilling will change, sometimes without warning. As a result, the weight on bit determined in the drill off test may no longer be optimum. Therefore, to achieve an optimum completion time for a well, the model used to determine the weight on bit corresponding to an optimum rate of penetration should be substantially continuously updated to match current drilling conditions as conditions in the well change during drilling.

In addition to achieving the fastest rate of penetration for weight on bit, successful drilling also requires drilling within the safety limits set for drilling operations to avoid costly, time-consuming problems that can be encountered during drilling. Problems that may be encountered during drilling operations include events such as sticking (or stuck pipe), kick, loss of circulation (or formation fracture), and washout. Sticking occurs when the drill string gets stuck in the wellbore, such as due to the build-up of cuttings in the wellbore due to inefficient clean out or collapse of the wellbore. Kick is any unexpected entry of formation fluid into the borehole. A kick may be detected, for example, by an excess in the flow rate of the returning fluid from the wellbore over the rate at which the drilling fluid is pumped into the wellbore. Loss of circulation is a loss of drilling fluid typically due to the presence or opening of a fractures in the formations exposed to the borehole. The loss of drilling fluid to the formations can be detected, for example, by a loss of the fluid flow rate returned to the surface through the wellbore annulus. Washout is excessive enlargement of the wellbore caused by solvent and erosion action by drilling fluid. Washout can cause severe damage to the formation, contamination of the connate formation fluids, and can waste costly drilling mud.

Recently, it has been shown that closely monitoring borehole fluid pressures (also referred to as "annular pressures"), especially near the bottom of the wellbore, during drilling can aid in the diagnosis of the condition of the wellbore and help avoid potential dangerous well control events during drilling operations. Annular pressure measurements during drilling, when used in conjunction with measuring and controlling other drilling parameters, have been shown to be particularly helpful in the early detection of events such as sticking, hanging, or balling stabilizers, mud problem detection, detection of cuttings build-up, improved steering performance.

During drilling operations, it is important to maintain the annular pressure of the drilling fluid within a range determined by the pressure limits for wellbore stability. Typically, the lower pressure limit for wellbore stability is the greater of the fluid pressure in the drilled formations, or the amount of pressure needed to avoid wellbore collapse. The upper pressure limit for wellbore stability is typically the lowest fracture pressure of the drilled formations exposed to the wellbore. When drilling fluid pressure exceeds the formation fracture pressure, there is a risk of creating or opening fractures, resulting in loss of drilling fluid circulation and damage to the affected formation. As is known in the art, fracture pressures of formations can be determined from overburden pressure and lateral stresses in the particular formations, and from mechanical properties of the particular formations.

Because the hydrostatic pressure of drilling fluid in the annulus of the borehole is a function of vertical depth and because movement of the mud induces frictional pressure drop, the annular pressure at a given depth is often converted to an equivalent density, referred to as an "equivalent circulating density" (ECD). Equivalent circulating density is considered a very useful representation of pressure in the annulus of the wellbore during drilling because it reflects both the hydrostatic and dynamic components of annular pressure and, once determined at one position, can be used to accurately predict annular pressure at any position in the wellbore. During drilling, the equivalent circulating density exceeds the static density of the fluid. The equivalent circulating density is caused by pressure losses in the annulus between the drilling assembly and the wellbore and is strongly dependent on the annular geometry and mud hydraulic properties. The maximum equivalent circulating density is normally at the drill bit, and pressures of more than 100 psi above the static mud weight may occur in long, extended reach and horizontal wells.

In many high pressure, high temperature (HPHT), deep-water, and extended reach wells, the margin between the formation pore pressure or formation collapse pressure, and the formation fracture pressure can diminish to the point that maintaining the equivalent circulating density within a narrow range can become critical to the success of the wellbore.

Measuring annular pressure while drilling has also been found to be useful in the early identification of drilling problems such as the inefficient removal of drill cuttings from the hole ("hole cleaning"). Increasing equivalent density of the drilling fluid caused by inefficient removal of drill cuttings and can help the driller avoid formation breakdown resulting from high pressure surges, or problems such as stuck drill pipe caused by packing off of the wellbore annulus with drill cuttings.

Equivalent circulating density may be calculated using hydraulics models from input well geometry, mud density, mud rheology, and flow properties, through each component of the circulating system. However, there are often large discrepancies between the measured and calculated pressures due to uncertainties in the calculations, poor knowledge of pressure losses through certain components of the circulation system, changes in the mud density and rheology with temperature and pressure, and/or poor application of hydraulics models for different mud systems. A more accurate reflection of equivalent circulating density may also be obtained from pressure data collected during drilling.

Leak-off tests (LOTs) and formation integrity tests (FITs) are very useful in determining limits that enable efficient management of the equivalent density of the drilling fluid within the safe pressure window. Using these tests, drilling engineers, or the like, can determine limits associated with drilling environment parameters, such as equivalent density.

As disclosed in C. D. Ward et al., *Pressure While Drilling Data Improves Reservoir Drilling Performance*, paper no. 37588, Society of Petroleum Engineers, Richardson, Tex., (1997), for drilling success in high angle wells, it is critical to maintain the equivalent circulating density (ECD) within safe operating limits defined by the formation fluid, collapse, and facture pressures. Operating outside these limits can lead to expensive lost circulation, differential sticking, and packing-off incidents. Monitoring the actual down-hole annulus pressure in real-time, such as with a pressure while drilling ("PWD") tool, rather than relying on inferred pressures from predictive models, has allowed borehole operators to better maintain ECD within the operating limits dictated by the formation being drilled.

In recent years, drilling operators have increasingly taken to monitoring downhole pressures using PWD instruments in an attempt to operate drilling rigs so as to maintain annular downhole pressures within the desired limits defined for the wellbore. Typically, such drilling rig operation includes having the rig operator (driller) manually control release of the drill string so as to keep the ECD (determined from the annular pressure measurements) within a selected range. How the driller controls the release of the drill string is somewhat unpredictable, and is related to the level of attention the driller has to give to a number of different tasks. Therefore, to achieve an optimum rate of penetration during drilling while avoiding undesired events during drilling, a method and a system are desired for automatically controlling drilling to achieve an optimum rate of penetration which takes into account safety limits defined for the drilling environment.

SUMMARY OF INVENTION

In one aspect, the invention relates to a system for automatically drilling a wellbore. In one embodiment, the system includes at least one pressure sensor, a processor, and a drill string release controller. The pressure sensor is disposed on a drill string in the wellbore and is responsive to pressure of a drilling fluid disposed in an annular space between a wall of the wellbore and the drill string. The processor is operatively coupled to the pressure sensor. The drill string release controller is operatively coupled to the processor. The processor is adapted to operate the drill string release controller to release the drill string at a reate so as to maintain an equivalent density of the drilling fluid substantially at a selected value.

In another aspect, the invention relates to a method for drilling a wellbore. In one embodiment, the method includes measuring pressure of a drilling fluid in an annular space between a wall of the wellbore and a drill string in the wellbore. The method also includes automatically controlling a rate of release of the drill string in response to the measured pressure so as to maintain an equivalent density of the drilling fluid substantially at a selected value.

Other aspects and advantages of the invention will be apparent from the following description and the appended claims.

DETAILED DESCRIPTION

Figure 1:
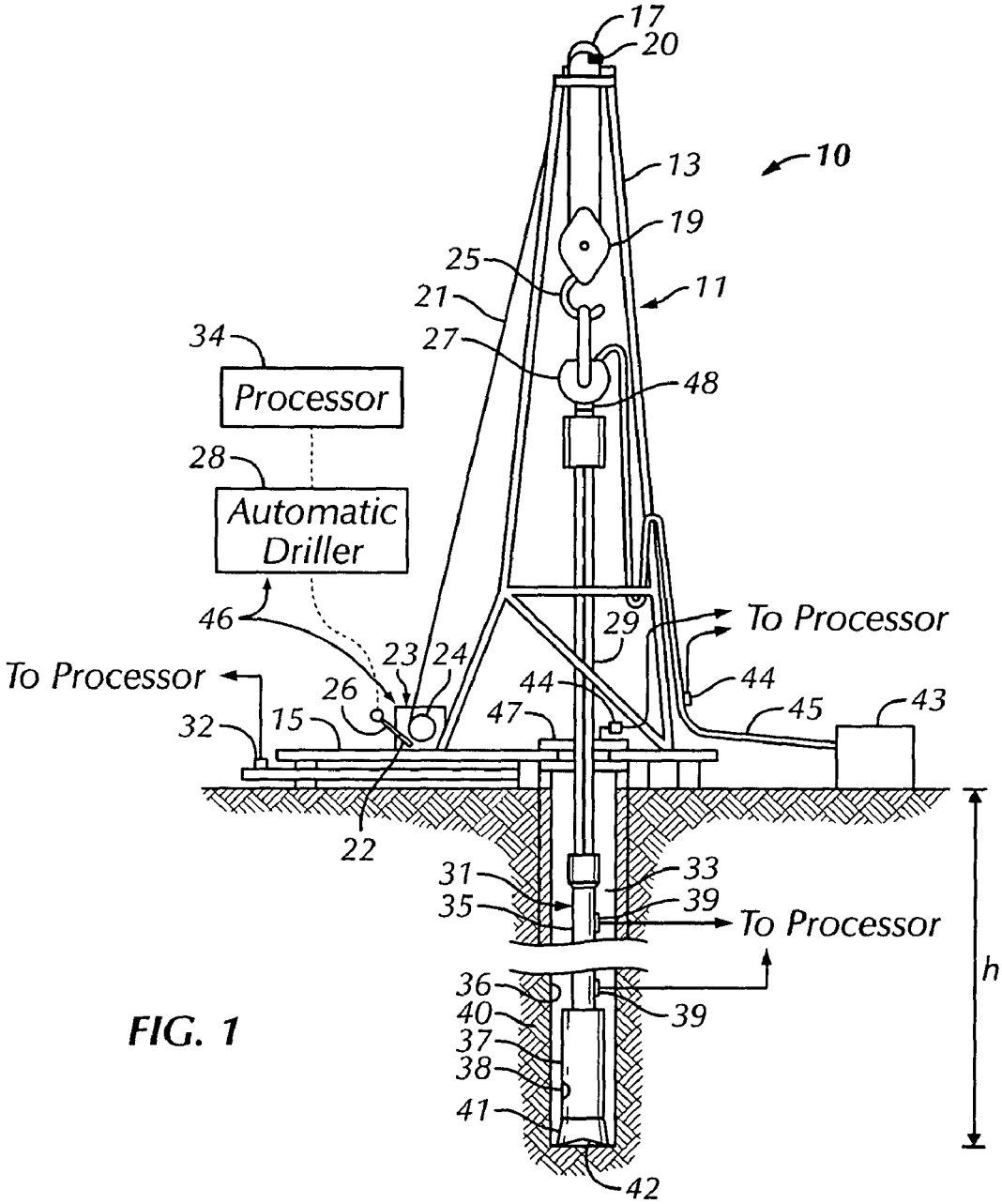
FIG. 1 is one example of a rotary drilling system in accordance with an embodiment of the present invention.

FIG. 1 shows one example of a rotary drilling system 10 in accordance with one embodiment of the present invention. The drilling system 10 includes a drilling rig 11. In the particular embodiment shown, the drilling rig 11 is a land rig. However, it will be apparent to those skilled in the art that the method and system of the present invention equally apply to any drilling system, including marine drilling rigs such as jack-up rigs, semi-submersibles, drill ships, and the like. Additionally, although the drilling rig 11 is a conventional rotary rig, wherein drill string rotation is performed by a rotary table turning a Kelly bushing, those skilled in the art will appreciate that the invention is applicable to other drilling technologies, such as top drive, power swivel, downhole hydraulic motors, coiled tubing units, and the like.

The drilling rig 11 includes a mast 13 supported on a rig floor 15. The drilling rig 11 also includes lifting gear comprising a crown block 17 and a traveling block 19. The crown block 17 is mounted on the mast 13 and coupled to the traveling block 19 by a cable 21. The cable 21 is driven by drawworks 23 which controls the upward and downward movement of the traveling block 19 with respect to the crown block 17. The traveling block 19 includes a hook 25 and a swivel 27 suspended by the hook 25. The swivel supports a kelly 29. The kelly 29 supports the drill string 31 suspended in the wellbore 33.

The drill string 31 includes a plurality of interconnected sections of drill pipe 35 and a bottom hole assembly (BHA) 37. The BHA 37 may include components such as stabilizers, drill collars, measurement while drilling (MWD) instruments, and the like. A drill bit 41 is connected to the bottom of the BHA 37. The particular configuration of and components used in the BHA 37 are not intended to limit the scope of the invention.

During drilling operations, the drill string 31 is rotated in the borehole 33 by a rotary table 47 that is rotatably supported on the rig floor 15. The rotary table 47 engages with the kelly 29. Drilling fluid, referred to as drilling "mud," is delivered to the drill string 31 by mud pumps 43 through a mud hose 45 connected to the swivel 27. To drill through earth formation 40, rotary torque and axial force are applied to the bit 41 to cause cutting elements on the bit 41 to cut into and break up the earth formation 40 as the bit 41 is rotated. The formation cuttings produced by the bit 41 as the bit 41 drills into the earth formation 40 are carried out of borehole 33 by the drilling fluid pumped by the mud pumps 43 down the drill string 31 and up the annular space between the drill string 31 and the wall 36 of the borehole 33.

The axial force applied on the bit 41 during drilling is typically referred to as the "weight on bit" (WOB). The torque applied to the drill string 31 at the drilling rig 11 to turn the drill string 31 is referred to as the "rotary torque." The speed at which the rotary table 47 rotates the drill string 31 is typically measured in revolutions per minute (RPM) and is referred to as the "rotary speed." The rate at which the drill bit 41 penetrates the formation 40 being drilled is referred to as the "rate of penetration" (ROP).

The rate of penetration (ROP) during drilling is related to the weight on bit, among other factors. Generally, rate of penetration increases with increased weight on bit up to a maximum rate of penetration for a particular drill bit and drilling environment. Additional weight on bit beyond the weight corresponding to the maximum rate of penetration typically results in a decreased rate of penetration. Thus, for any particular drill bit and drilling environment, there is an optimum weight on bit that results in a maximum rate of penetration.

As is well known to those skilled in the art, the weight of the drill string 31 is typically substantially greater than the optimum or desired weight on bit for drilling. Therefore, during drilling, part of the weight of the drill string 31 is supported by the drilling rig 11 and the drill string 31 is maintained in tension over most of its length above the BHA 37. The weight on bit is typically equal to the weight of the drill string 31 in the drilling mud less the weight suspended by hook 25, and any weight supported by the wall 36 of the wellbore 33. The portion of the weight of the drill string 31 supported by the hook 25 is typically referred to as the "hook load."

In accordance with one embodiment of the present invention, the drilling system 10 includes at least one pressure sensor 38, a processor 34, and a drill string release controller 46.

The pressure sensor 38 is adapted to measure pressure of the drilling mud in the annular space between the drill string 31 inserted in the wellbore 33 and the wall 36 of the wellbore 33. The pressure sensor 38 is preferably disposed at a position near the bottom 42 of the drill string 31.

In the exemplary embodiment shown in FIG. 1, the pressure sensor 38 is provided in the bottom hole assembly 37 located above drill bit 41. The pressure sensor 38 is operatively coupled to a measurement-while-drilling system (not shown separately) in the BHA 37. Additional pressure sensors may be located throughout the drill string. Pressure measurements made by the sensor 38 may be communicated to equipment at the earth's surface including a processor 34 using well known systems and methods such as mud pressure modulation telemetry. Alternatively, pressure measurements may also be communicated or transmitted along an electrical conductor that is integrated by some means into the drill string 31. Other systems and methods include the applying a combination of electrical and magnetic principles to the drill string 31.

The particular manner in which the measurements of the pressure sensor 38 is communicated to the processor 34 is not a limitation on the scope of the invention. The processor 34 may be any form of programmable computer, including a general purpose computer or a programmed-for-purpose computer or embedded processor designs. The processor 34 is operatively connected to the drill string release controller 46. The drill string release controller may be, for example, a brake band controller, or a hydraulic/electric motor, which is coupled to the drawworks 23.

Figure 2:
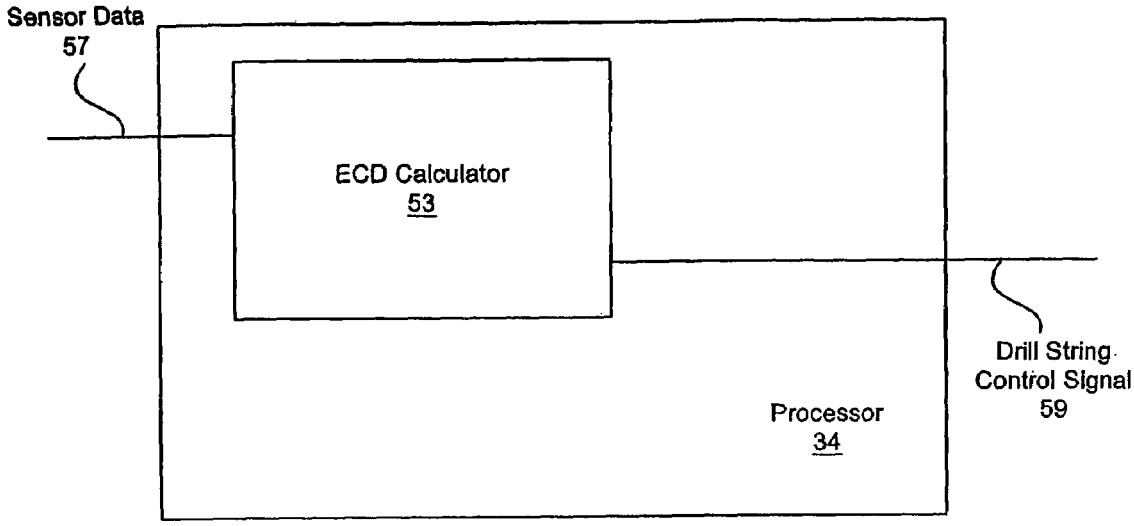
FIG. 2 is a block diagram of a processor for one embodiment of the present invention.

One embodiment of a processor in accordance with the present invention is illustrated, for example, in FIG. 2. In this embodiment, the processor 34 includes an ECD calculator 53. The ECD calculator is used to calculate equivalent density (or a parameter representative of annulus pressure, such as a maximum annulus pressure at the bottom of the wellbore). The ECD calculator may be a subroutine operating on the processor or a separate element. The ECD calculator 53 accepts sensor data 57 and calculates an equivalent density of the drilling fluid based on the sensor data 57. The sensor data 57 may be data received from the pressure sensor (38 in FIG. 1).

Equivalent density may be calculated from an annulus pressure measurement taken at a selected position in the annulus based on the familiar expression for hydrostatic pressure of a column of fluid:

$$p=\rho gh, \quad \text{(Eq. 1)}$$

where p represents the pressure, ρ represents the fluid density, g represents gravity, and h represents the vertical depth of the position at which the pressure is measured. Solving the above expression for density provides the following expression for equivalent circulating density:

$$ECD=p/gh. \quad \text{(Eq. 2)}$$

For the embodiment of the processor 34 shown in FIG. 2, the ECD calculator 53 accepts as input sensor data 57 (e.g., pressure p from the pressure sensor 38 in FIG. 1). Further, the ECD calculator 53 also accepts as input a vertical depth h (not shown). This vertical depth h may be determined by any method known in the art for determining the vertical depth of a sensor. For example, the vertical depth of the pressure sensor 38 at any time may manually entered into the processor 34 or, preferably may be automatically calculated from directional survey data for the wellbore trajectory and the known length of the drill string inserted into the wellbore (the length being referred to as measured depth). As is known in the art, the directional survey data may be collected at selected time intervals and transmitted to the surface using a measurement-while-drilling (MWD) tool (not shown) separately disposed in the BHA (37 in FIG. 1), as described above with respect to FIG. 1.

Using the vertical depth and measurements from the pressure sensor 38, the ECD calculator 53 calculates an equivalent density. The processor 34 generates a drill string control signal 59 based on output from the ECD calculator 53. The drill string control 59 signal is supplied to a drill string controller (46 in FIG. 1) and operates the drill string controller (46 in FIG. 1) so that the drill string (31 in FIG. 1) is released into the wellbore (33 in FIG. 1) so as to maintain a selected value of equivalent density.

In one embodiment, the drill string control signal 59 is generated dependent upon calculated values for equivalent density. For example, if the equivalent density is determined to be at or above an upper limit selected for equivalent density, then the drill string control signal 59 generated by the processor 34 is a signal that results in a reduction in the rate of release of the drill string (31 in FIG. 1). Reducing the rate of release of the drill string (31 in FIG. 1) is desired to reduce the volume of cuttings suspended in the drilling fluid. Reducing the volume of cuttings suspended in the drilling fluid in turn reduces the equivalent density. Otherwise, if the equivalent density is determined to be below the upper limit, then the drill string control signal 59 generated by the processor 34 is a signal that results in an increase in the rate of release of the drill string (31 in FIG. 1) into the wellbore (33 in FIG. 1).

In embodiments of the invention, the selected value of equivalent density may be any selected value, including a selected constant value, a limit value determined by the drilling environment, such as a maximum equivalent density corresponding to a fracture pressure, or any value within a given range defined for a drilling operation. In preferred embodiments, the selected value for equivalent density is any value less than a density value corresponding to a fracture pressure of formation exposed to the borehole.

Figure 3:
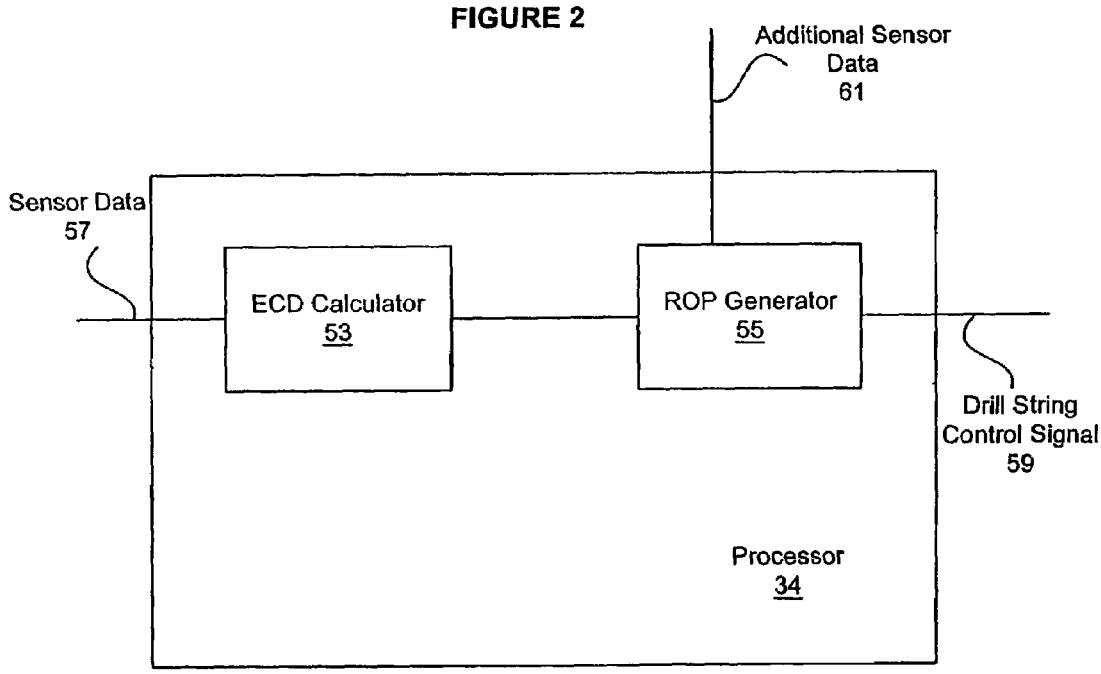
FIG. 3 is a flow diagram of a method for drilling a wellbore in accordance with one embodiment of the present invention.

In one or more embodiments, the drilling system 10 may include additional pressure sensors. For example, a plurality of pressure sensors 39 may be disposed at axially spaced locations in the annular space between the drill string 31 and the wall 36 of the wellbore 33. Pressure sensors 32, 44 may also be disposed at locations to be in communication with drilling fluid entering and exiting the wellbore 33. For these embodiments, the processor of the drilling system, may be adapted to accept input from a variety of sensors, for example, a pressure sensor 38, a hook load sensor 48, and a hook speed sensor 20. One example of a processor in accordance with one of these embodiments is shown in FIG. 3. The processor 34 includes an ECD calculator 53 and an ROP generator 55.

The ECD calculator 53 accepts sensor data 57 and calculates equivalent density (or similar parameter) based on the sensor data 57. The sensor data 57 includes at least annulus pressure obtained from a pressure sensor (such as 38 in FIG. 1). The ECD calculator 53 generates an output in response to the calculated value of equivalent density. This output may simply by the calculated value for equivalent density.

The ROP generator 55 accepts as input output from the ECD calculator 53 and additional sensor data 61, such as data received from the hook lead sensor (48 in FIG. 1) and the hook speed sensor (20 in FIG. 1). From these inputs, the ROP generator 55 determines an optimum or desired rate of penetration (ROP). For example, if the calculated equivalent density is below a maximum limit defined for ECD, then the ROP generator 55 uses an optimization subroutine to determine an optimum ROP based on the additional sensor data 61. The processor 34 generates a drill string control signal 59 based on that optimum ROP to release the drill string (31 in FIG. 1) at a rate to achieve the optimum ROP. Alternatively, if the calculated equivalent density is above the maximum limit defined for ECD, then the ROP generator 55 generates output corresponding to a reduction in the rate of release of the drill string and the processor 34 outputs a drill string control signal 59 to slow down the release of the drill string and reduce the equivalent density of the drilling fluid to a value below the maximum limit.

The ROP generator may use any type of optimization subroutine known in the art for determining an optimum rate of penetration. For example, one ROP optimization subroutine that may be used is disclosed in U.S. Pat. No. 6,192,998 to Pinckard, which is assigned to the assignee of the present invention and is incorporated herein by reference. Using this optimization routine, data from a hook speed sensor (20 in FIG. 1) can be used to determine the actual drill string ROP. One type of a hook speed sensor that may be used is a drum rotation speed sensor, such as a magnetic or optical encoder coupled to the drum of the crown block (17 in FIG. 1) or the drawworks (23 in FIG. 1). Alternatively, data obtained from a hook position sensor (not shown) may be used to determine ROP. In such case, the ROP would be the time derivative of measurements obtained from the hook position sensor. Data obtained from a hook speed (20 in FIG. 1) or hook position sensor (not shown) can be used to determine ROP because hook movement (which governs release of the drill string into the wellbore 33) corresponds directly to drum rotation. Additionally, data obtained from a hook load sensor (48 in FIG. 1) may be used to determine a weight on bit.

Referring back to FIG. 1, the drill string release controller 46 of the drilling system 10 is operatively coupled to the processor 34, such that the drill string control signal is accepted as input to the drill string release controller 46. Based on the drill string control signal (59 in FIG. 2), the drill string release controller 46 controls the release of the drill string 31 into the wellbore 33. In this way, the processor 34 operates the drill string release controller 46 to maintain a selected value of equivalent density during drilling.

The drill string release controller 46 may include any actuator implementation known in the art that can be used to control the release of a drill string into a wellbore. For example, in one or more embodiments, the drill string release controller 46 may comprise a rig brake actuator. The rig brake actuator may be manipulated based on the drill string control signal (59 in FIG. 2) to slow down the release of the drill string in response to an increase in equivalent density or vice versa.

In one embodiment, the rig brake actuator may comprise an actuator which can be manipulated to apply an amount of braking force to a drum 24 of the drawworks 23 to increase or decrease the rate of release of the drill string by the drawworks 23, the increase or decrease in the rate of release being a function of the amount of braking force applied to the drum 24. One example of this type of rig brake actuator is illustrated, in FIG. 1. In accordance with this embodiment, the drawworks 23 includes a brake 22 coupled to the drum 24 of the drawworks 23 and adapted to apply an amount of force to the drum 24 which can be selectively adjusted to control the rate at which the cable 21 is released from the drum 24. The amount of force applied to the drum 24 by the brake 22 may be controlled by controlling the amount of force applied to a handle 26 of the brake 22. An automatic driller 28 may be operatively coupled to the handle 26 of the brake 22 based on the drill string control signal (59 in FIG. 2) received from the processor 34. Those skilled in the art will appreciate that this is only one example of how the processor 34 may be used to operate the drill string release controller to release the drill string into the wellbore to maintain a selected value of equivalent density. In other embodiments, annulus pressure proximal the drill bit 41 may be used as a control parameter, and the processor 34 may be programmed to operate the drill string release controller 46 similar to that described above to maintain annulus pressure below a maximum pressure limit defined for the drilling operation.

In an alternative embodiment, the drill string release controller 46 control the rate of release of the drill string 31 into the wellbore 33 by applying a reverse torque to the cable drum 24 of the drawworks 23. For example, the reverse torque may be applied by a hydraulic motor coupled to the drawworks 23. One example of this type of implementation is disclosed in U.S. Pat. No. 4,875,530 to Frink et al Alternatively, the rate of release of the drill string from the drum 24 or a similar device may be controlled by controlling a signal supplied to an electronic motor operatively connected to the drive shaft of the drum 24 used to control rotation of the drum 24. The particular manner in which the drill string release controller 46 is implemented is not a limitation on the scope of the invention.

Figure 4:
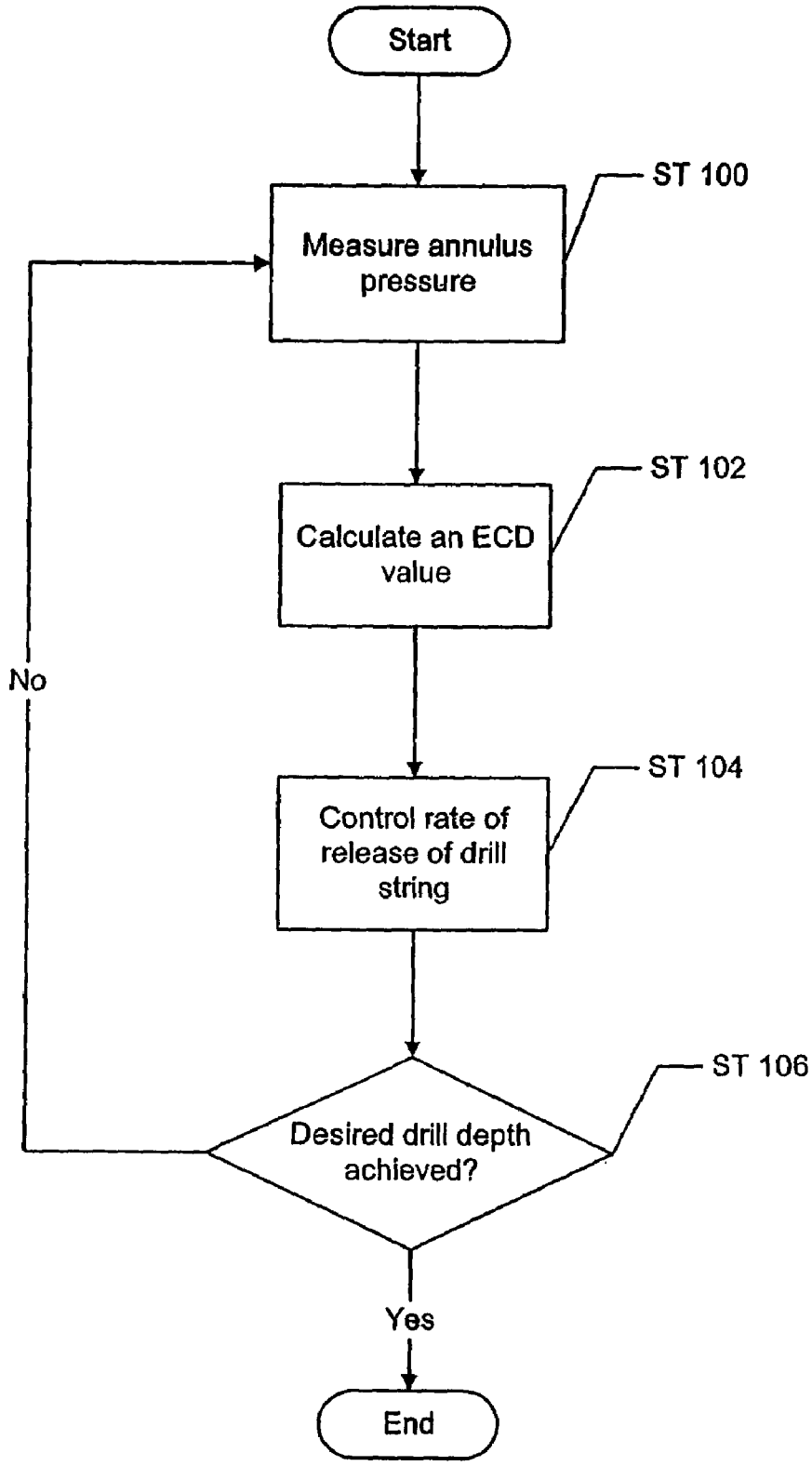
FIG. 4 is a flow diagram of a method for drilling a wellbore in accordance with another embodiment of the present invention.

In another aspect, the invention provides a method for automatically drilling a wellbore. A flow diagram of a method in accordance with one embodiment of this aspect of the invention is shown in FIG. 4. The method includes measuring an annulus pressure in an annular space between a drill string inserted in a wellbore and a wall of the wellbore close to bottom of the wellbore 100. The annulus pressure may be measured using a pressure sensor, such as pressure sensor 38 in FIG. 1. The method also includes controlling release of the drill string in response to the measured pressure to maintain a selected value of equivalent density in the wellbore during drilling, at 104. In the embodiment shown, the method also includes calculating equivalent density based on the measured pressure at 102. In one or more embodiments, predictive learning algorithms are used in calculating and/or determining an equivalent density.

As previously mentioned, Equation 2 may be used to calculate equivalent density. Alternatively, equivalent density may be calculated using data obtained from a plurality of pressure sensors (e.g., 38 and 39 in FIG. 1) axially space apart in the annular space between the drill string (31 in FIG. 1) and the wall (36 in FIG. 1) of the wellbore (33 in FIG. 1). In this case, equivalent density may be calculated from the difference between measurements obtained from two sensors. For example, the following expression may be used to calculate equivalent density from two pressure measurements:

$$ECD=(p_2-p_1)/g(h_2-h_1), \quad \text{(Eq. 3)}$$

where $p_i$; represents the pressure measured by sensor i, g represents gravity, and $h_i$ represents the vertical depth of the position at which the pressure $p_i$ is measured.

In accordance with the exemplary embodiment in FIG. 4, once the desired drill depth has been achieved, determined at 106, the method for drilling is terminated. Otherwise, the method continues by obtaining updated measurements for annulus pressure, calculating a new value of equivalent density, and controlling the rate of release of the drill string based on the new value for equivalent density to maintained a selected value of equivalent density during drilling. In other embodiments, the method may be terminated at any time and for any reason at the driller's discretion.

In one or more embodiments, the rate of release of the drill string is controlled so that when equivalent density is at or above a selected maximum value, the rate at which the drill string is released is reduced. Similarly, in one or more embodiments, release of the drill string is controlled so that when equivalent density is within an acceptable range defined for the drilling operation, the rate at which the drill string is being released is increased or, alternatively, held constant. Also, in one or more embodiments, the rate of release of the drill string is controlled so that when equivalent density is at or below a defined minimum value set for drilling, the rate at which the drill string is released is increased to increase equivalent density.

The amount of the reduction or increase in the rate of release of the drill string can be determined as a function of the difference between a limit value (such as a selected maximum or minimum value) and the calculated value for equivalent density. Alternatively or additionally, the amount of the reduction or increase in the rate of release of the drill string may be determined as a function of the rate at which equivalent density is approaching a limit value. For example, if equivalent density is approaching a limit rapidly, the change in the release of the drill string may be greater than if equivalent density were approaching the limit at a slower rate.

In one or more other embodiments, when equivalent density is within limits defined for drilling, the method for drilling also includes determining an optimum rate of penetration based on one or more selected drilling operation parameters, such as weight on bit and releasing the drill string at an optimum rate within the limits defined for the drilling operation. In accordance with these embodiments, when equivalent density is determined to be at or beyond a limit value, the release of the drill string is controlled based on equivalent density to maintain the equivalent density with the selected drilling limits. For example, if equivalent density is determined to be at or above a selected maximum ECD, release of the drill string is slowed down to maintain equivalent density below the maximum value.

One ROP optimization method that may be used to determine an optimal rate of penetration for embodiments of the invention is disclosed in U.S. Pat. No. 6,192,998 to Pinckard, which has been incorporated herein by reference. In one embodiment, this optimization method may be used when equivalent density is below a selected maximum value to determine an optimum weight on bit corresponding to an optimum rate of penetration from a modeled relationship between rate of penetration and weight on bit for the current drilling conditions. In this case, release of the drill string may be controlled by automatically adjusting release of the drill string to substantially match the optimum weight on bit. When equivalent density is at or beyond the selected maximum value, release of the drill string is reduced to reduce equivalent density.

In one or more embodiments, measure pressure further includes measuring pressure at a plurality of axially spaced locations in the annular space between a drill string and a wall in the wellbore. Measuring pressure may also include measuring pressure of the drilling fluid entering and/or exiting the wellbore. Also, in one or more embodiments, the method further includes determining a vertical depth corresponding to the annulus pressure measurement. The vertical depth and the annulus pressure measurement may be used to calculate the equivalent density as described above.

In one or more embodiments, controlling the rate of release of the drill string into the borehole includes operating a rig brake actuator which controls the release of the drill string into the wellbore. The rig brake actuator may control release of the drill string by applying an amount of braking force to a drum of a drawworks to control the rate at which the cable is released from the drawworks. The rig brake actuator may alternatively control release of the drill string into the wellbore by applying a reverse torque to a cable drum of the drawworks to control the rate at which the cable is released from the drawworks. However, the particular manner in which release of the drill string is controlled is not a limitation on the scope of the invention.

In one or more embodiments, the rate of release of the drill string is controlled so that equivalent density does not exceed a selected maximum value for ECD. The maximum value for ECD may be determined from a fracture gradient of a formation exposed to the wellbore, such as a value that is a safety margin less than the fracture gradient. In other embodiments, a limits for ECD may be any value selected or determined by a skilled artisan.

In one or more embodiments, when the current value for equivalent density is less than a selected value, release of the drill string may be controlled by matching a weight on bit corresponding to an optimum rate of penetration. When equivalent density is at or above the selected value, release of the drill string may be controlled by matching a weight on bit corresponding to a reduced weight on bit. The rate at which the drill string weight is reduced may be determined based on a recent history or a trend determined for equivalent density. For example, the amount of the reduction may be calculated as a function of the rate at which equivalent density is approaching a limit value. In particular, when equivalent circulating density is approaching a limit value at an increasing rate, the amount of the reduction may be higher than when equivalent circulating density is approaching the limit value at a slower rate. In a preferred embodiment, when the equivalent density less than and approaching a maximum value for ECD, release of the drill string is controlled to reduce the rate at which the equivalent density approaches the limit, to maintain the equivalent density at a value proximal to but below the limit value.

Advantageously, one or more embodiments of the invention may be used to control automatic drilling to achieve optimum rates of penetration during drilling while automatically taking into consideration safety limits defined for drilling operations. Additionally, one or more embodiments of the invention may be used to operate a drilling rig so as to maintain annular downhole pressures within the desired limits while maximizing the rate at which the wellbore is drilled. Further, one or more embodiments of the invention may be used avoiding undesired events during drilling while maximizing the rate at which a wellbore is drilled.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system for drilling a wellbore, comprising:

at least one pressure sensor disposed on a drill string in the wellbore, the sensor responsive to pressure of a drilling fluid disposed in an annular space between a wall of the wellbore and the drill string;

a processor operatively coupled to the pressure sensor; and a drill string release controller operatively coupled to the processor, wherein the processor operates the drill string release controller to release the drill string at a rate so as to maintain an equivalent density of the drilling fluid substantially at a selected value, and the processor controls the drill string release controller to at least one of increase the rate of release when the equivalent circulating density is less than the selected value and decrease the rate of release when the equivalent circulating density is greater than the selected value.

2. The system of claim 1, further comprising means for determining a vertical depth of the at least one pressure sensor.

3. The system of claim 1, wherein the drill string release controller comprises a rig brake actuator.

4. The system of claim 1, further comprising a plurality of pressure sensors disposed at axially spaced apart positions along the wellbore, each of the plurality of pressure sensors operatively coupled to the processor.

5. The system of claim 1, wherein the processor determines an optimum rate of release of the drill string and to releases the drill string at the lesser of the optimum rate and a rate such that the equivalent density is at most a predetermined value.

6. The system of claim 1, further comprising a hook load sensor which measures a weight of the drill string suspended by a hook, the hook load sensor operatively coupled to the processor.

7. The system of claim 1, further comprising a sensor which measures a parameter related to the rate of release of the drill string in the wellbore, wherein the sensor measures the parameter operatively coupled to the processor.

8. The system of claim 1, wherein the selected value is at most a value of equivalent density corresponding to a fracture pressure of a formation exposed to the drilling fluid in the wellbore.

9. The system of claim 1, wherein the processor calculates the equivalent density of the drilling fluid using the sensor.

10. A system for drilling a wellbore, comprising:

at least one pressure sensor disposed on a drill string in the wellbore, the sensor responsive to pressure of a drilling fluid disposed in an annular space between a wall of the wellbore and the drill string;

a processor operatively coupled to the at least one pressure sensor; and a drill string release controller operatively coupled to the processor, wherein the processor operates the controller to release the drill string at a rate so as to maintain an optimum rate and a rate resulting in a maximum value of equivalent density of the drilling fluid, wherein the drill string release controller at least one of increases the rate of release of the drill string when equivalent circulating density is less than a selected value and decreases the rate of release of the drill string when the equivalent circulating density is greater than the selected value.

11. The system of claim 10, further comprising means for determining a vertical depth of the at least one pressure sensor.

12. The system of claim 10, wherein the drill string release controller comprises a rig brake actuator.

13. The system of claim 10, further comprising a plurality of pressure sensors disposed at axially spaced apart positions along the wellbore.

14. The system of claim 10, further comprising a hook load sensor which measures a weight of the drill string suspended by a hook, the hook load sensor operatively coupled to the processor.

15. The system of claim 10, further comprising a sensor which measures a parameter related to the rate of release of the drill string in the wellbore, wherein the sensor measures the parameter operatively coupled to the processor.

16. The system of claim 10, wherein the selected value is at most a value of equivalent density corresponding to a fracture pressure of a formation exposed to the drilling fluid in the wellbore.

17. The system of claim 10, wherein the processor calculates the equivalent density of the drilling fluid using the sensor.

18. A method for drilling a wellbore, comprising:

measuring pressure of a drilling fluid in an annular space between a wall of the wellbore and a drill string in the wellbore;

automatically controlling a rate of release of the drill string in response to the measured pressure so as to maintain an equivalent density of the drilling fluid substantially at a selected value; and wherein the automatically controlling comprises reducing the rate of release when the equivalent density increases and increasing the rate of release when the equivalent density decreases.

19. The method of claim 18, further comprising determining a vertical depth at which the measuring pressure is performed.

20. The method of claim 18, wherein the automatically controlling comprises operating a rig brake actuator.

21. The method of claim 18, wherein measuring pressure comprises measuring pressure at a plurality of axially spaced apart positions in said annular space.

22. The method of claim 18, further comprising determining an optimum rate of release of the drill string, and wherein the controlling further comprises releasing the drill string at the lesser of the optimum rate and a rate such that the equivalent density is at most the selected value.

23. The method of claim 18, wherein a rate of the reducing and the increasing comprises a function of the difference between the selected value and the equivalent density.

24. The method of claim 18, wherein a rate of the reducing and the increasing comprises a function of a rate at which the equivalent density approaches a limit value.

25. The method of claim 18, further comprising calculating the equivalent density using the pressure of the drilling fluid.

26. The method of claim 18, further comprising determining an optimum rate of penetration when equivalent density is within limits defined for drilling.

27. A method for drilling a wellbore, comprising:

measuring pressure of a drilling fluid in an annular space between a wall of the wellbore and a drill string in the wellbore;

calculating an equivalent density of the drilling fluid in response to the measured pressure;

determining an optimum rate of release of the drill string into the wellbore in response to the calculated equivalent density; and automatically controlling a rate of release of the drill string so as to maintain the lesser of the optimum rate and a rate which results in a selected value of the equivalent density.

* * * * *